United States Patent [19]

Bar et al.

[11] Patent Number: 5,054,712

[45] Date of Patent: Oct. 8, 1991

[54] PROJECTILE WITH CORRECTABLE TRAJECTORY

[75] Inventors: Klaus Bar, Lauf; Gunther Lehrieder, Rothenbach, both of Fed. Rep. of Germany

[73] Assignee: Diehl GmbH & Co., Nuremberg, Fed. Rep. of Germany

[21] Appl. No.: 580,333

[22] Filed: Sep. 10, 1990

[30] Foreign Application Priority Data

Sep. 19, 1989 [DE] Fed. Rep. of Germany ..... 3931173

[51] Int. Cl.[5] ..... F42B 15/18

[52] U.S. Cl. ..... 244/3.22; 102/202; 102/381

[58] Field of Search ..... 244/3.21, 3.22; 102/202, 381

[56] References Cited

U.S. PATENT DOCUMENTS

| | | | |
|---|---|---|---|
| 3,034,434 | 5/1962 | Swaim et al. . | |
| 4,211,378 | 7/1980 | Crepin | 244/3.22 |
| 4,503,773 | 3/1985 | Bolieau | 102/202 |
| 4,982,913 | 1/1991 | Miller | 244/3.22 |

FOREIGN PATENT DOCUMENTS

| | | | |
|---|---|---|---|
| 0028966 | 3/1985 | European Pat. Off. . | |
| 0208160 | 1/1987 | European Pat. Off. . | |
| 2019244 | 4/1972 | Fed. Rep. of Germany . | |
| 2264243 | 7/1973 | Fed. Rep. of Germany . | |
| 2714688 | 10/1977 | Fed. Rep. of Germany . | |
| 2504703 | 10/1982 | France | 244/3.22 |

*Primary Examiner*—Mark Hellner

*Attorney, Agent, or Firm*—Scully, Scott, Murphy & Presser

[57] ABSTRACT

A spin-stabilized projectile with a correctable trajectory, wherein the projectile possesses lateral or transverse thrust-propulsion devices which are distributed about the circumference thereof, each incorporating an impulse-generating charge inclusive an electrically-activatable detonator arranged beneath a cover which is radially ejectable relative to the longitudinal axis of the projectile. The detonator, with the presence of a connecting cable which initially extends coaxially with the cover and then thereafter extends at an angle relative thereto, is arranged in the transitional region intermediate the impulse-generating charge and the cover, whereby the cover, with conformance of its external contour to the contour of the encompassing casing surface of the projectile, is fixed to the structure of the projectile across a rupture location, which is hermetically sealed radially inwardly of the impulse-generating charge with respect to the center of the projectile.

7 Claims, 2 Drawing Sheets

PROJECTILE WITH CORRECTABLE TRAJECTORY

BACKGROUND OF THE INVENTION

1. Field of the Invention

The present invention relates to a spin-stabilized projectile with a correctable trajectory, wherein the projectile possesses lateral or transverse thrust-propulsion devices which are distributed about the circumference thereof, each incorporating an impulse-generating charge inclusive an electrically-activatable detonator arranged beneath a cover which is radially ejectable relative to the longitudinal axis of the projectile.

2. Discussion of the Prior Art

A projectile of that type is already known in the technology from the disclosure of German Patent 22 64 243 in the configuration of an airborne body which rotates during flight, and wherein, with the aid of at least one impulse which can be triggered during the flight and which is oriented radially relative to the airborne body, it is possible to change the trajectory in order to increase the probability of scoring a hit or striking a target. The impulse is generated with the aid of a weight or mass component which is acceleratable through the action of an impulse-generating charge and leads approximately to a parallel offset out of the momentary trajectory, when it is oriented towards the center of gravity of the projectile. Information with regard to the momentary offset of the trajectory with regard to the target which is to be attacked received or computed by a control installation determines in which momentary roll position of the projectile there is triggered the lateral or transverse impulse; in effect, which of a plurality of present and still available lateral or transverse thrust-propulsion devices which are arranged distributed about the periphery of the projectile, currently possesses a most likely expedient spatial orientation for correction of the trajectory, and as a consequence thereof is to be electrically activated.

Kinematically comparable trajectory correcting devices, but which are operatively based on a control nozzle recoil or reaction effect, have become known from the disclosure of European Patent 00 28 966 or from the disclosure of German Patent 27 14 688. In the last-mentioned publication there is employed a central gas generator for selectively openable gas jet-discharge nozzles. Each nozzle possesses a lug which can be screwed into a radial wall opening of the projectile, which contains, within a threaded female chuck, a form-fittingly positioned insert having load-transmissively positioned therein, a radially oriented plug. Operative between the plug and the insert is a detonator which is radially wired towards the center of the projectile, so as to hollow out the internal space of the insert through the outward expulsion of the plug and to thusly facilitate a deformation of the wall structure of the resultingly hollow-cylindrical insert, so that the latter is pressed out from the screwthreaded receptacle by means of the excess or superatmospheric pressure which is generated by the gas generator and, as a result, there can be opened a gas discharge-nozzle. When once an opening has been freed, thereafter no further ones can any longer be opened. A lateral or transverse thrust-propulsion device which is constructed in that manner does evidence the advantage with regard to an impulse propulsion mechanism of the type considered herein in that it allows a lengthier acting lateral or transverse force to exert an affect on the projectile; however, which is just that not desired for a projectile which is stabilized under a high spin, inasmuch as the lateral thrust-orientation changes with the inherent rotation of the projectile.

SUMMARY OF THE INVENTION

According, it is an object of the present invention to construct a projectile of the type which is considered herein in such a manner as to be able to bring into effect the highest possibly intense but precise trajectory-correcting influences.

The foregoing object is inventively achieved in that the projectile of the type described herein is constructed so that the detonator, with the presence of a connecting cable which initially extends coaxially with the cover and then thereafter extends at an angle relative thereto, is arranged in the transitional region intermediate the impulse-generating charge and the cover, whereby the cover, with conformance of its external contour to the contour of the encompassing casing surface of the projectile, is fixed to the structure of the projectile across a rupture location, which is hermetically sealed radially inwardly of the impulse-generating charge with respect to the center of the projectile.

In accordance with the foregoing object, through the provision of a rupture or breaking location which can be constructively defined within broad bounds it is possible to determine for each individual impulse-generating charge, under which conditions of excess or superatmospheric pressure, the relatively large mass of the closure cover, which in its configuration will not adversely influence the aerodynamic characteristics of the projectile, can be laterally expelled and thus supported by the reaction gas-discharge from the ignited impulse charge, so as to initiate a relatively intense and timewise extremely precise but short-term reaction impulse against the projectile.

This reaction impulse, for effecting a lateral displacement or offset of the trajectory, is oriented through the center of gravity of the projectile, while instead thereof or in addition thereto, lateral or transverse thrust-propulsion devices of that type which are located out of a cross-sectional plane extending through the center of gravity, will upon their activation impress a moment about the center of gravity of the projectile, which leads to an offset in the trajectory. The inventive construction of the lateral thrust-propulsion devices with the activation of the impulse charge through a detonator which engages radially therein from the exterior, hereby causes an optimally rapid conversion of the impulse charge into reaction gas which, in the interest of obtaining a higher radial acceleration of the cover mass, should only upon the attainment of an optimal excess or super-atmospheric pressure beneath the cover, tear open the rupture or braking locations thereof employed for fastening to the wall structure of the projectile.

The rupture or breaking connection for the integration of the cover can be provided in an integral construction of the cover with the mounting element thereof, for example, being screwed into the casing surface of the projectile at a mechanically-weakened edge region of the cover, but also as a form-fitted connection between the radially expellable cover and its mounting element. A hollow space between the inside of the cover and the impulse-generating charge which is arranged therebelow simplifies the guidance of the conductors for effecting the electrical connection of the detonator located coaxially below the cover and extending radially into the impulse-generating charge without any essential reduction in the reactive mass of the cover. Through the use, for example, of this type of detonator arrangement, the structure of the projectile can be constructed so as to be completely sealed with respect to its interior, so that the centrally arranged components thereof (such as the warhead and the impulse-control circuit), are hermetically bulkheaded against the mechanical and pyrotechnic effects of the ignited impulse charge, and are thereby optimally protected.

BRIEF DESCRIPTION OF THE DRAWINGS

Further features and advantages of the invention may now be more readily ascertained from the following detailed description thereof predicatd on the essentially diagrammatically represented exemplary embodiments of the invention, taken in conjunction with the accompanying drawings; in which.

DETAILED DESCRIPTION

Figure 1:
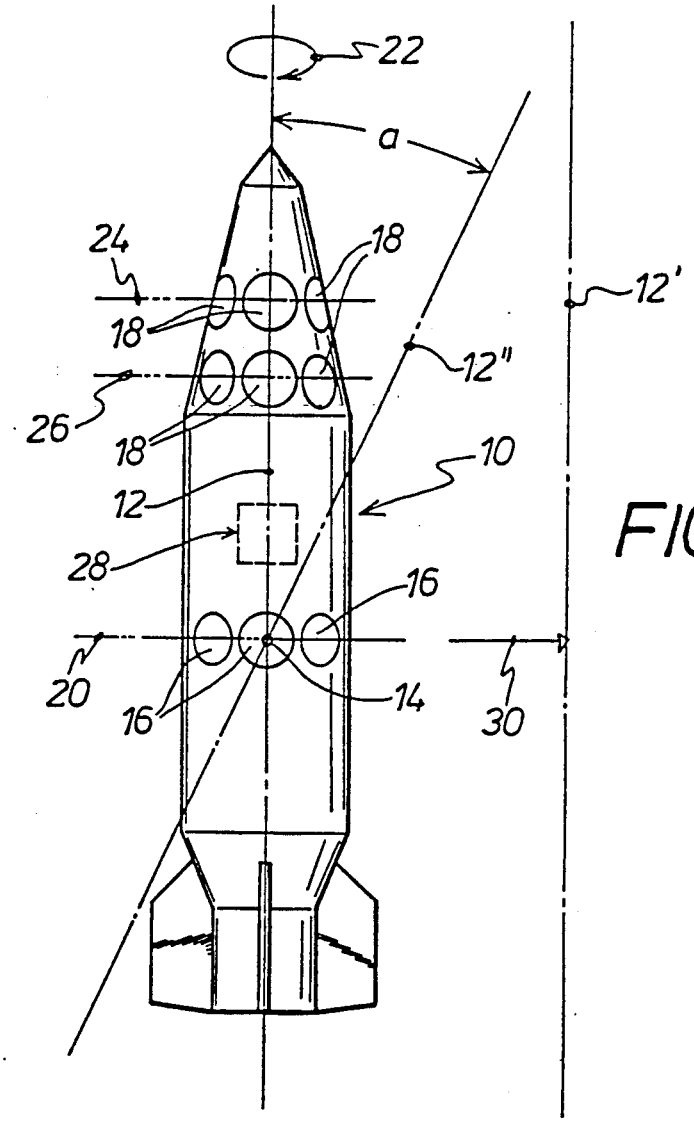
FIG. 1 illustrates a generally diagrammatic longitudinal side view of the trajectory-correctable projectile.

FIG. 1 illustrates a projectile 10 having a central longitudinal axis 12 and center of gravity 14. The projectile possesses a plurality of lateral or transverse thrust-propulsion devices 16 which are arranged distributed about its circumference. These devices arranged within a plane which is oriented perpendicularly of the central longitudinal axis 12, which plane extends through the center of gravity 14. Further lateral thrust-propulsion devices 18 are arranged within planes 24, 26 which are also oriented perpendicularly relative to the central longitudinal axis 12; however, which are at a distance from the center of gravity 14. When, through the intermediary of a control device 28, which is illustrated by a block, there is activated one of the propulsion devices 16 in dependence upon the projectile spin 22, then as a result of a reaction effect, there is produced an approximately parallel displacement or offset 30 of the trajectory of the projectile 10 into a longitudinal axis 12'. When, in contrast therewith, there is activated one of the propulsion devices 18 with the aid of the control device 28, then the longitudinal axis 12 is tilted; for example, by the amount of the angle 'a' in the direction towards the longitudinal axis 12''. Through the suitable activation of one or another of the propulsion devices 16, 18, it is in accordance therewith possible to control the path of flight or trajectory of the projectile 10.

Figure 2:
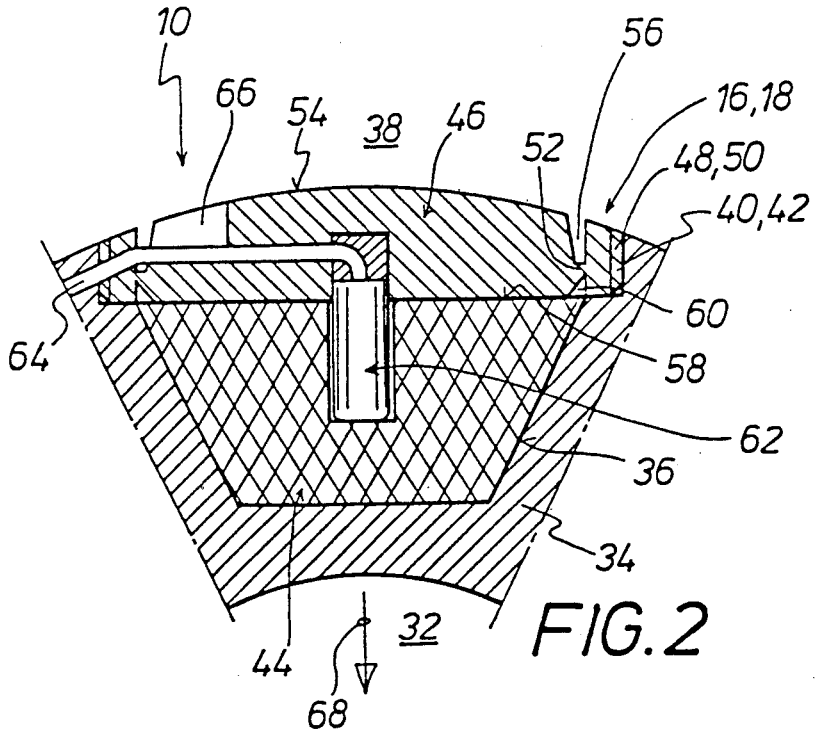
FIG. 2 illustrates a fragmentary sectional view through a first embodiment of the projectile pursuant to FIG. 1.

FIG. 2 illustrates a fragmentary sectional view through the projectile 10 in the form of a segment of an annulus, from which there can be ascertained a configuration of a propulsion device 16 or, respectively, 18. The projectile 10 possesses a central hollow space 32 for the receipt of a payload; for example, an active charge inclusive of safe-and-arm and triggering devices. The wall structure 30 of the projectile 10 has cutouts 36 formed therein about the circumference thereof, which cutouts 36 widen in a radial direction extending from the central hollow space 32 of the projectile 10 towards its outside 38. Each cutout is provided on its outer end section with a cylindrical recess 40 possessing an internally threaded portion 42. Arranged in the cutout 36 is an impulse-generating charge 44. Each cutout 36 is closed by means of an associated cover 46 which, in this instance, is pressed against the impulse-generating charge 44, and which possesses a circularly extending edge 48 having an externally threaded portion 50 conforming with the internally threaded portion 42. Extending about the cover 46 at a distance from the peripheral edge 48 is a rupture or breaking location 52 of a specified breaking strength. For this purpose, encompassing grooves 56, 60 are provided on the outside 54 and on the inside 58 of the cover 46.

Projecting radially from the outside into the impulse-generating charge 44 is a detonator 62 with an electrical connecting cable 64, which is operatively connected with a control device 28 (shown in FIG. 1 as a block). Provided on the outside 54 of the cover 46 is an assembling aperture 66 for the connecting cable 61. From FIG. 2 there can also be ascertained that the outside 54 of the cover 46 possesses a surface contour which is in conformance with the external surface contour of the projectile 10.

When the detonator 62 is electrically activated through the operation of the control device 28 (as shown in FIG. 1), then the applicable impulse-generating charge 44 is triggered. As a consequence thereof, within the cutout 36 which is closed off by means of the cover 46, there builds up such a high pressure, that the cover 46 will finally tear away along the breaking or rupture location 52 and will be radially expelled away from the projectile 10. Resulting therefrom, in accordance with the impulse-maintaining composition, is a movement of the projectile 10 in the direction of the arrow 68.

Figure 3:
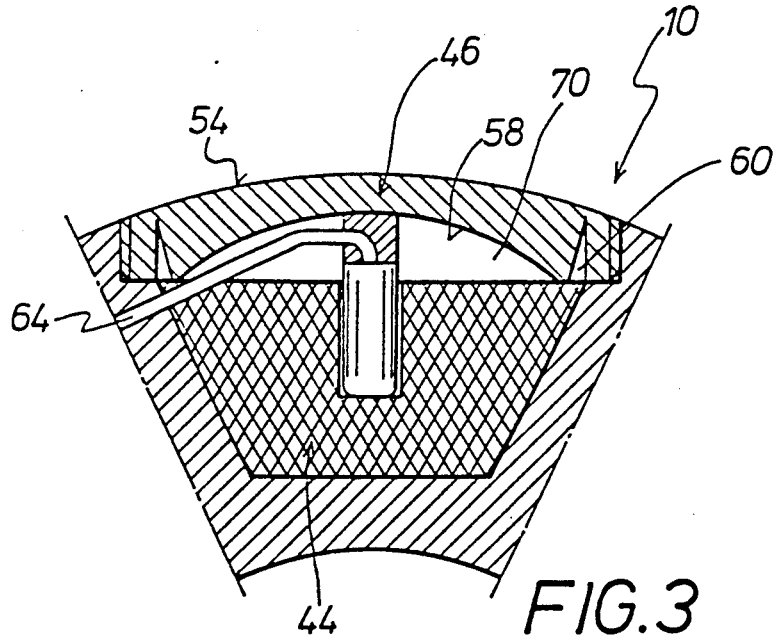
FIG. 3 illustrates a fragmentary cross-sectional view similar to that of FIG. 2 taken through a second embodiment of the projectile.

FIG. 3 illustrates an embodiment of the projectile 10 which, in particular, distinguishes itself from that of FIG. 2 in that the inside 58 of the cover 46 does not contact directly against the impulse-generating charge 44, but is concavely curved or recessed, so that a pressure-assuming interspace 70 is formed between the impulse-generating charge 44 and the inside 58 of the cover 46. As a result thereof, the connecting cable 64, in contrast with FIG. 2, can be arranged so that rather than extending through the cover 46 it is located below the cover 46. Moreover, in this construction, the cover 46 is provided only on the inside thereof with an encompassing groove 46 while its outside 54 is smooth.

Figure 4:
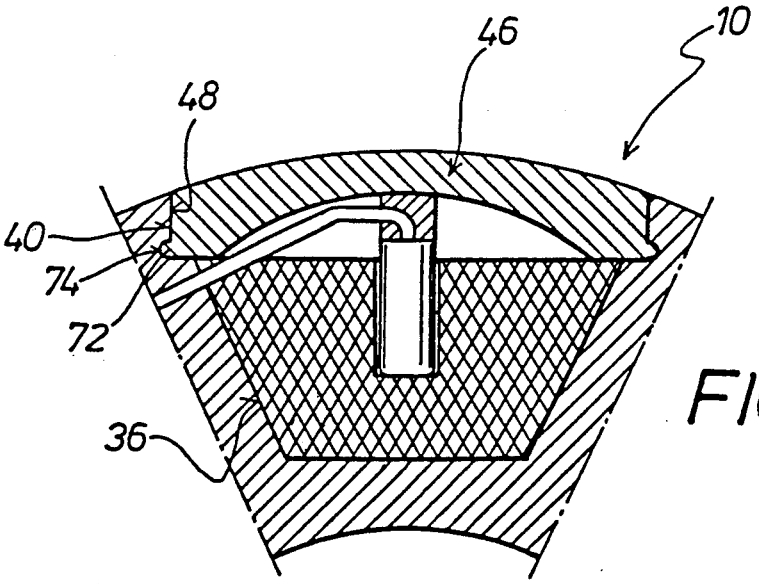
FIG. 4 illustrates a fragmentary sectional view similar to those in FIGS. 2 and 3 taken through a third embodiment of the projectile.

FIG. 4 illustrates a third embodiment of the projectile 10, shown in a fragmentary segment similar to that of FIGS. 2 and 3, whereby for the provision of a form-fit rupture or breaking location, the cover 46 is equipped with an encompassing fastening bead 72, and the cylindrical recess 40 in the cutout 36 having a groove 74 therein forming an undercut. As a result thereof, it is no longer necessary to construct the cylindrical recess 40 with an internally threaded portion and to provide the encompassing edge 48 of the cover 46 with an externally threaded portion, which signifies a simplification in the production thereof. The encompassing fastening bead 72 on the cover 46 which is pressed into the groove 74, in effect, thusly forms a connecting segment of specified breaking strength.

WHAT IS CLAIMED IS:

1. A spin-stabilized projectile having a correctable trajectory; including propulsion devices for producing a lateral thrust being distributed about the circumference of said projectile, each said propulsion device having an impulse-generating charge including an electrical-actuatable detonator arranged below a cover which is radially outwardly expellable relative to the longitudinal axis of the projectile, said detonator having a connecting cable which initially extends coaxially with the cover and then at an angle relative thereto and being arranged in a transitional region intermediate the impulse-generating charge and the cover, said cover having an external surface contour conforming with the contour of the encompassing casing surface of the projectile being fastened to the structure of the projectile through a rupture location, and which is hermetically closed radially inwardly of the impulse-generating charge with regard to the center of the projectile.

2. Projectile as claimed in claim 1, wherein said cover has a concavely curved inner surface and an edge region radially contacting against the impulse-generating charge so as to form a hollow space through which there immersedly extends the connecting cable below the edge of the cover for the electrical actuation of the detonator.

3. Projectile as claimed in claim 1, wherein the inside of the cover has substantially the entire surface thereof contacting against the impulse-generating charge for the detonator, and with the path of the connecting cable for the electrical actuation of the detonator extending through a passageway radially relative to the axis of the cover.

4. Projectile as claimed in claim 1, wherein the breaking location for each said cover is formed within an external thread extending about the edge of the cover for the form-fitting positioning in a cutout provided for the receipt of the impulse-generating charge.

5. Projectile as claimed in claim 4, wherein said breaking location is a singe-piece rupture location possessing a mechanically weakened region.

6. Projectile as claimed in claim 4, wherein a form-fitting multi-part breaking location is provided with a fastening bead surroundingly engaging into a groove.

7. Projectile as claimed in claim 1, wherein the propulsion devices for generating lateral thrust are arranged along the projectile circumference in different cross-sectional planes of the projectile, one said plane extending through the center of gravity of the projectile, and at least one further plane being offset a considerable distance from the center of gravity towards the region of a conical leading end portion of the projectile.

* * * * *